United States Patent [19]

Belew

[11] 4,018,423

[45] Apr. 19, 1977

[54] EMERGENCY DESCENT DEVICE

[75] Inventor: Robert R. Belew, Huntsville, Ala.

[73] Assignee: The United States of America as represented by the Administrator of the National Aeronautics and Space Administration, Washington, D.C.

[22] Filed: Oct. 16, 1975

[21] Appl. No.: 623,188

[52] U.S. Cl. ..... 254/158; 188/291

[51] Int. Cl.[2] ..... A62B 1/12; B66D 5/04

[58] Field of Search ..... 254/158, 160; 182/74, 182/75; 188/295, 305, 293, 290–291, 307

[56] References Cited

UNITED STATES PATENTS

| | | | |
|---|---|---|---|
| 628,736 | 7/1899 | Young | 254/160 |
| 1,888,912 | 11/1932 | Doose | 254/160 |
| 3,595,528 | 7/1971 | Virkki | 254/160 |
| 3,946,989 | 12/1974 | Tsuda | 254/160 X |

*Primary Examiner*—Robert B. Reeves
*Assistant Examiner*—Fred A. Silverberg
*Attorney, Agent, or Firm*—L. D. Wofford, Jr.; John R. Manning

[57] ABSTRACT

A descent device is provided for emergency descent from tall structures and for lowering objects from high elevations such as a hovering helicopter. The device includes a rotating spool having a cable wound thereon for descent and a rotation-retarding vane member which rotates in a fluid cylinder. An adjustable bypass is provided for the fluid as the vane member rotates therein so that the speed of descent can be adjustably controlled.

7 Claims, 9 Drawing Figures

Fig. 3.
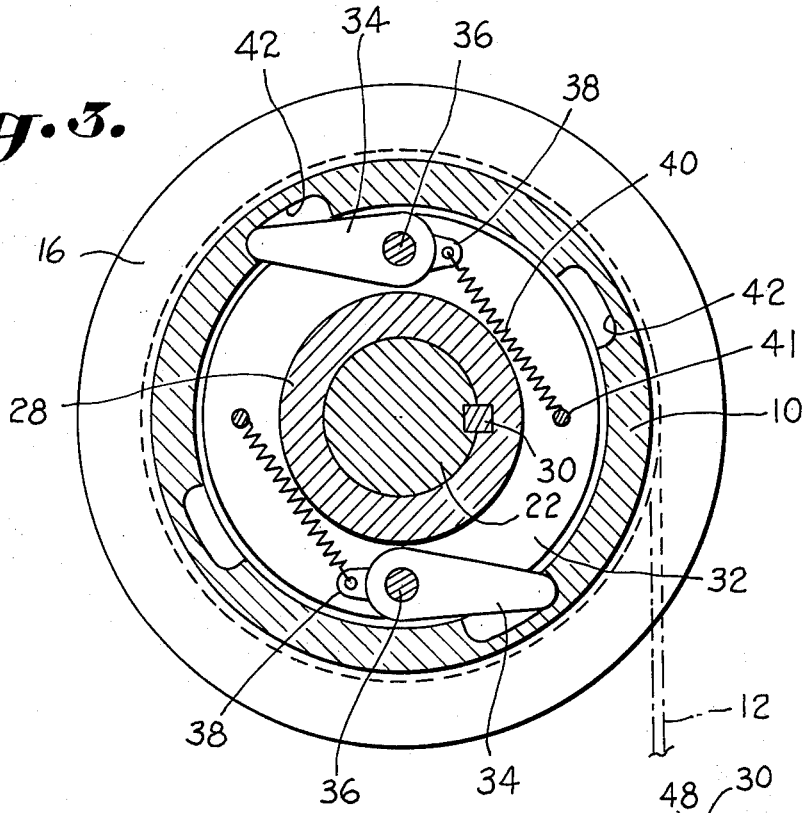
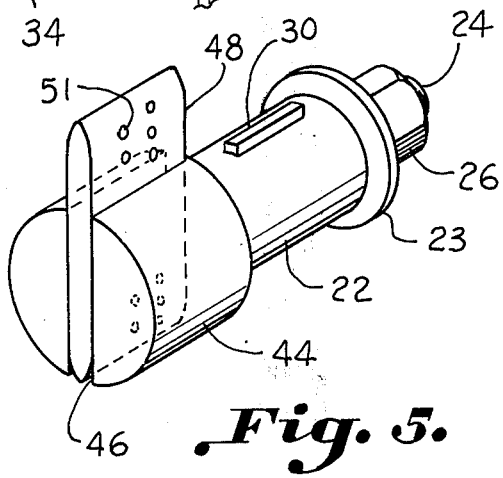
Fig. 5.
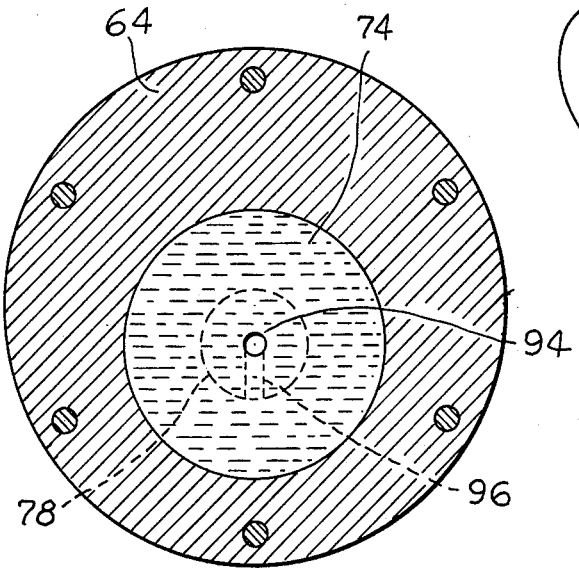
Fig. 4.

EMERGENCY DESCENT DEVICE

ORIGIN OF THE INVENTION

The invention described herein was made by an employee of the United States Government and may be manufactured and used by or for the Government for governmental purposes without the payment of any royalties thereon or therefor.

BACKGROUND OF THE INVENTION

This invention relates to emergency descent devices of the type shown in U.S. Pat. No. 530,863 and 516,117 wherein a spool having a cable member wound thereon is retarded in its rotation as the cable member descends by a rotating vane member in a fluid cylinder. More particularly, the invention relates to improvement in such devices and to providing an adjustable bypass for the fluid around the vane member so that the speed of descent can be controlled. The improved device has much broader application than those devices heretofore known for lowering equipment from elevated places such as lowering equipment from a hovering helicopter wherein it is necessary to control the speed at which the equipment is lowered. The improved invention also has application to heavier loads.

SUMMARY OF THE INVENTION

A descent device for emergency descents and for lowering equipment from tall structures and the like is provided comprising a cylindrical housing having an interior space containing a fluid, and a rotor shaft carried for rotation in the housing having a reduced end portion of reduced diameter extending through an opening in one end of the housing. A spool member is carried by the reduced end portion of the rotor shaft so as to rotate the rotor shaft when rotated in a first direction while being rotatable relative to the rotor shaft when rotated in a second opposite direction. A cable member is wound about the spool member having one end connected thereto. A diametrical slot is formed in the rotor shaft carried within the interior space of said cylindrical housing, and a vane member is slideably carried in the diametrical slot extending across said interior space of said housing.

A channel means is provided for transferring the fluid from one side of the vane member to the other as the vane member is rotated in the interior space by the rotor shaft to retard the rotation thereof.

An end cap member encloses the cylindrical housing on an end opposite the end through which the reduced portion of said rotor shaft extends and means carried by the end cap provide an adjustable bypass channel around the vane member for the fluid contained in the interior space of the housing as the vane member rotates so as to adjust the retarding force.

Thus, the fluid and the rotating vane member produce a retarding force on the rotation of the spool member in the first direction due to the unwinding of the cable member from the spool member and the adjustable bypass means may be adjusted so as to control the speed of descent of said cable.

Accordingly, it is an important object of the present invention to provide a descent device for emergency descents and for lowering equipment from elevated places which permits a safe descent at a controlled speed.

Another important object of the present invention is to provide a descent device for emergency descents and for lowering equipment whereby the speed at which the descent occurs can be varied.

Another important object of the present invention is to provide a descent device which can be used to lower heavy equipment from a hovering helicopter and the like and in which the speed of descent can be adjustably controlled.

These and other objects and advantages of the present invention will become apparent upon reference to the following specification, attendant claims and drawings.

BRIEF DESCRIPTION OF THE DRAWINGS

FIG. 3 is a sectional view taken along line 3—3 of FIG. 1, FIG. 4 is a sectional view taken along line 4—4 of FIG. 1, FIG. 5 is a perspective view illustrating a rotor shaft and vane member utilized in the descent device constructed in accordance with the present invention.

DESCRIPTION OF A PREFERRED EMBODIMENT

Figure 1:
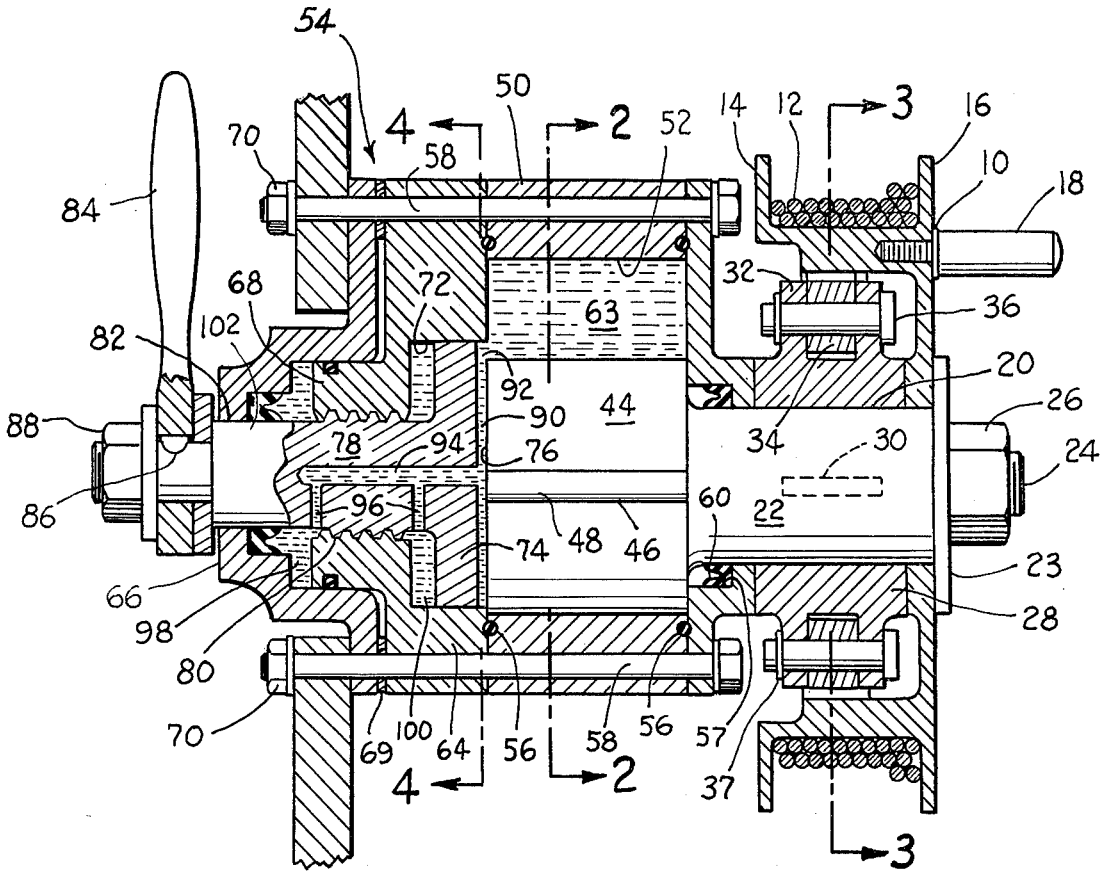
FIG. 1 is a side cut-away elevational view illustrating a descent device constructed in accordance with the present invention.

The descent apparatus is provided for producing a controlled descent of a person from a tall structure, such as a building, as he grabs onto an emergency cable and the cable unwinds from a spool, or for controlling the descent of equipment from elevated places such as a hovering helicopter. Referring now to FIG. 1 in detail, the device includes a spool 10 upon which any suitable type of cable 12 is coiled. The spool 10 has outer walls 14 and 16 for retaining the cable therein. Extending outwardly from the outer wall 16 is a rotatable handle 18 which enables the spool to be manually rotated to coil or wind the cable 12 thereon. The wall 16 of the spool 10 has an opening 20 extending therethrough through which a cylindrical, reduced diameter portion 22 of a rotor extends. On the outer end of the reduced diameter portion 22 of the rotor is a circular flange 23 and a threaded end portion 24 which is threaded for receiving a nut 26 for securing the spool 10 to the portion 22 of the rotor. It is to be understood that the spool 10 is adapted to be rotated freely relative to the rotor 22 when the spool is rotated to wind the cable 12 thereon.

A concentric latching mechanism is also provided on the reduced diameter portion 22 of the rotor and includes a cylindrical latching ring member 28 which is keyed by a key 30 to the rotor 22. The latching ring 28 has a radially, outwardly extending flange 32 upon which pawls 34 are pivotally mounted by pins 36 secured by spring clips 37. The inner end of each pawl 34 has an outwardly extending portion 38 into which one end of a spring 40 is attached. The other end of the spring 40 is attached to pin 41 projecting from the radially extending flange 32 of the latch. The purpose of the spring 20 is to pivot the reduced opposite end of the pawl 34 outwardly so that such will engage in a recess 42 provided in the inner walls of the spool 10.

Figure 2:
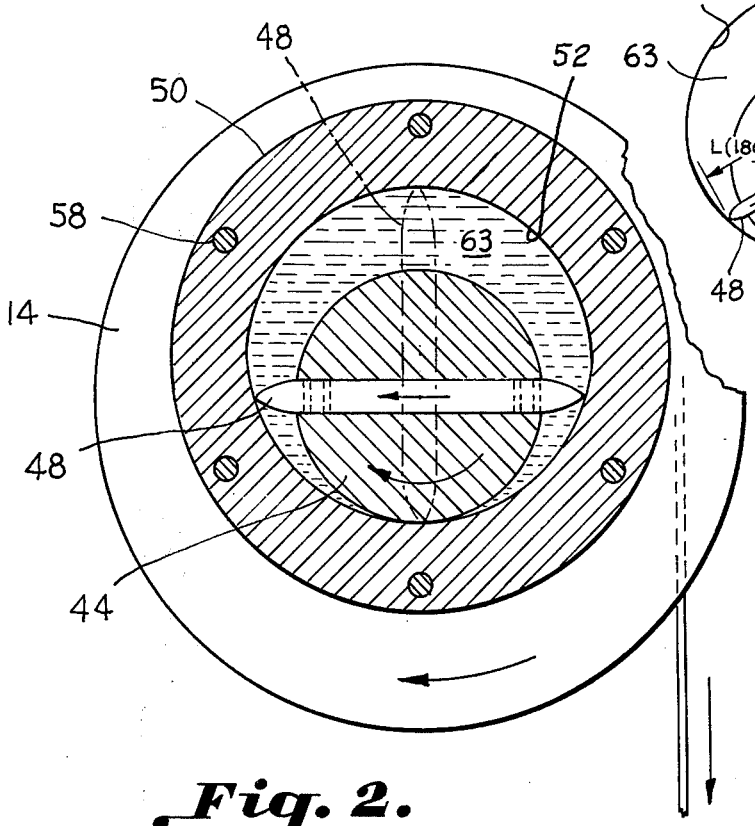
FIG. 2 is a sectional view taken along line 2—2 of FIG. 1.
Figure 2A:
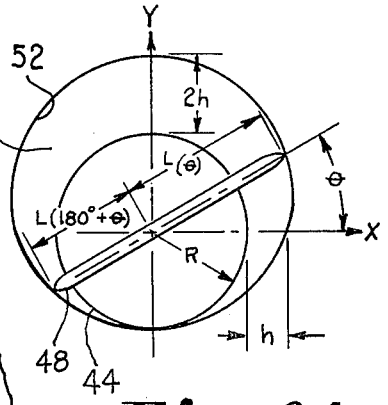
FIG. 2*a* is a schematic diagram illustrating the geometry of the interior surface of fluid containing cylindrical housing constructed in accordance with the present invention.

The inner end of the rotor 22 has an enlarged diameter portion 44 provided with a diametrical extending slot 46 therein. Extending through this slot 46 is a sliding vane member 48 which has its outer ends engaging the inner wall of a substantially cylindrical housing 50. The vane 48 has a plurality of holes 51 formed adjacent each end thereof. An inner chamber 52 of the housing 50 has an inner surface closely approximating that of a right cylindrical surface defined by the following equations (see FIG. 2*a*):

$$L(\theta) = R + h\,(1 + \text{Sin}\,\theta), \text{ and}$$

$$L(180° + \theta) = R + h\,[1 + \text{Sin}(180° + \theta)]$$

A cap assembly, designated generally at 54, is bolted to the housing 50. O-rings 56 are provided at the opposite ends of the housing providing a seal coupling between the housing and the cap assembly 54 at one end and an end plate 57 at the other end. The bolts 58 extend through the cap 54 and the housing 50. Seals 60 are also provided between the rotor 22 and the end plate 57 so that a fluid 63 is retained in the housing. This fluid could be any suitable fluid and in one particular embodiment it may be silicone. The perforations or holes 51 provide channel means permitting transfer of the fluid 63 from one side of the vane member 48 to the other. Thus, the vane-rotor assembly revolves in the confined fluid medium 63 and developes torque as a function of rotational velocity providing a slowed and controlled descent rate.

The housing 50 is mounted to the structure upon which it is desired to locate the emergency descent device by any suitable bracket means so as to prevent the housing from rotating as the cable is unwound therefrom.

In operation, when an emergency descent is desired say, from a space launching platform or the like, the person would merely grab hold of the downwardly extending cable 12. The cable could be provided with any suitable seat or harness to be attached for safety reasons. As the person begins to descent, the cable unwinds from the spool 10 rotating the spool in a first direction. When the spool begins rotating, the pawls 34 engage within the recessed slots 42 provided in the inner wall of the spool which causes the latch ring 28 to also rotate. Since the latch ring is keyed at 30 to the rotor 22, such, in turn, rotates the entire rotor in the first direction. The rate of rotation of the rotor is the same as the rotation of the spool; however, it is to be understood that gearing could be provided therebetween so as to vary the rotation of the rotor relative to the rotation of the spool. As the rotor is rotated, the vane 48 is also rotated compressing the fluid 63 within the housing 50. The vane 48 slides within the slot 46 maintaining the opposite ends thereof always in contact with the interior wall 52 of the housing. As the rotor is rotated, the fluid flows through holes 51 provided in the vane producing a retarding or restraining force to the rotor. The diameter, number and arrangement of holes extending through the vane would control the restraining force. Therefore, the speed of descent of the person on the cable can be suitably controlled.

When the spool member 10 is rotated by handle 18 in a second direction to rewind the cable 12, the pawls 34 do not engage in recesses 42 and therefore the spool rotates relative to the rotor portion 22. In this manner the retarding force of vane 48 need not be encountered during rewind.

The cap assembly 54 includes a cylinder head member 64 and an end cap member 66. The cylinder head member 64 encloses the interior space 52 of the cylinder housing 50 at the end of the housing opposite the end through which the reduced end portion 22 of the rotor extends. The cylinder head is then, in turn, carried by the end cap member 66 which is fitted over an upwardly extending flange member 68 of the cylinder head 64 and is spaced therefrom by a pair of spacing rings 69. The entire assembly is secured together by the bolt members 58 having a conventional nut member 70 fastened over the threaded ends thereof. The cylinder head member 64 has a concentric cylinder bore 72 formed therein in which a piston 74 is slideably moves toward and away from an end surface face 76 of the enlarged rotor portion 44.

A threaded piston stem 78 is integral with the piston 74 and is threadably received within internal threads formed in a central opening 80 of the upper flange 68. The threaded stem extends to the exterior of the descent device through an aligned opening 82 formed in the end cap member 66. A lever member 84 is keyed at 86 to the extended end of the threaded stem 78 exterior of the end cap and is fastened thereto by a nut member 88 received over a threaded end of the stem. As the lever 84 is rotated the threaded stem moves the piston 74 toward and away from the end surface face 76 of the rotor to vary the size of the clearance space 90 therebetween. If the piston 74 is moved toward the end face surface 76 of the rotor reducing the clearance space 90 to zero then the only path that the fluid 63 has from one side of the vane 48 to the other is through the perforations 51 formed therein. However, when the piston 74 is moved away from the end face surface 76, an additional channel is provided through a space 92, between the edge surface of the cylinder bore 72 and the edge of rotor surface 76, and the bypass or clearance channel 90 to the other side of the vane member 48. As the clearance space 90 is increased more fluid can flow from one side of the vane member 48 to the other, thus, less retarding force is provided against the rotation of the rotor vane allowing a faster rate of descent. The maximum retarding force is provided when the clearance space 90 is zero, thus providing the slowest rate of descent of the unwinding cable member 12.

The piston 74 and threaded stem 78 integral therewith have an axial bore 94 formed therein with a plurality of radial bores 96 extending outwardly therefrom communicating with fluid spaces 98 and 100. As the piston 74 moves backwards and forwards in the cylindrical bore 72 of the cylinder head 64, the fluid is displaced between the fluid spaces 98 and 100 and the fluid clearance space 90. Suitable sealing means is utilized at 102 for sealing the threaded stem 78 at the opening 82.

Figure 6:
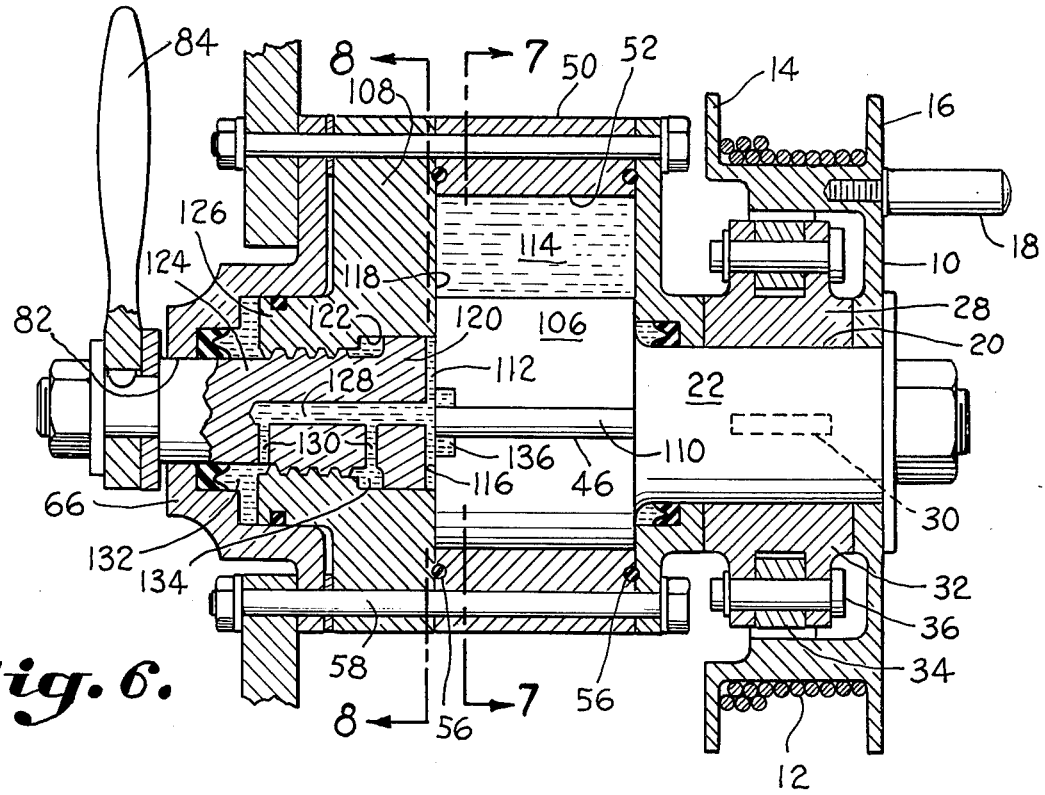
FIG. 6 is a side cut-away elevational view of an alternate embodiment of a descent device constructed in accordance with the present invention.

Referring now to FIG. 6, an alternate embodiment of a descent device is illustrated comprising essentially the same components as illustrated in FIG. 1 except that the enlarged portion 106 of the rotor 22 is modified along with the configuration of the cylinder head member 108. In addition, the vane member 110 is similar to the vane member 48 of FIG. 1 except that the perforations 51 are omitted adjacent the ends thereof. A clearance space 112 is provided which does not communicate with the fluid space 114 as it does in FIG. 1. The end surface 116 of the rotor portion 106 abuts the end surface 118 of the cylinder head 108. A piston 120 slides in a cylindrical bore 122 formed in the cylinder head 108 for providing a variable clearance between the piston and the end surface 116 of the rotor and providing a variable fluid space at 112. A threaded stem member 124 is threadably received in an upper flange 126 of the cylinder head and extends through the aligned opening 82 formed in the end cap member 66, which is identically shown in FIG. 1. An axial bore 128 has a pair of radial bores 130 extending outwardly therefrom communicating with fluid spaces 132 and 134.

Figure 7:
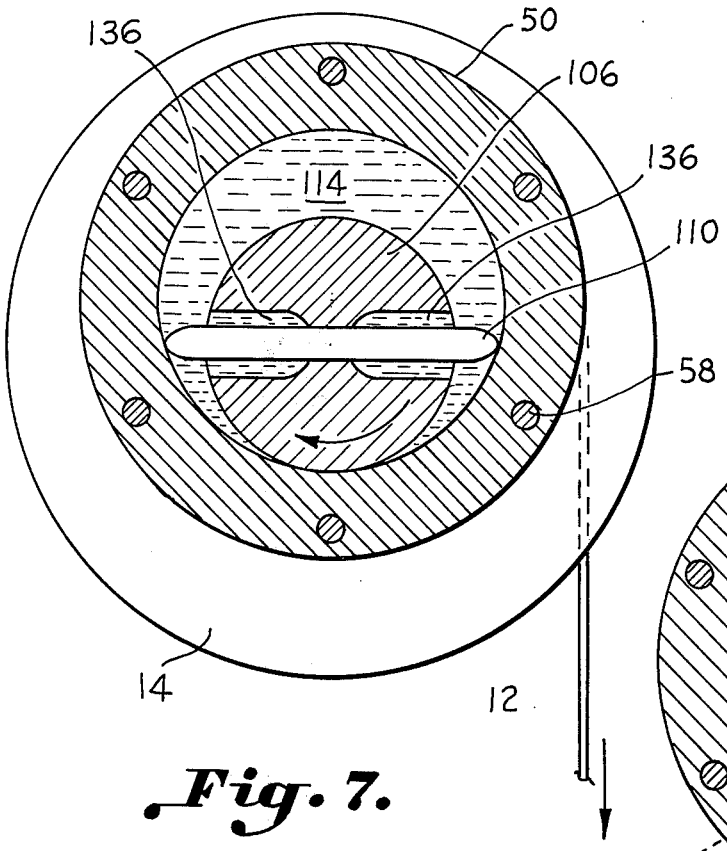
FIG. 7 is a sectional view taken along line 7—7 of FIG. 6.
Figure 8:
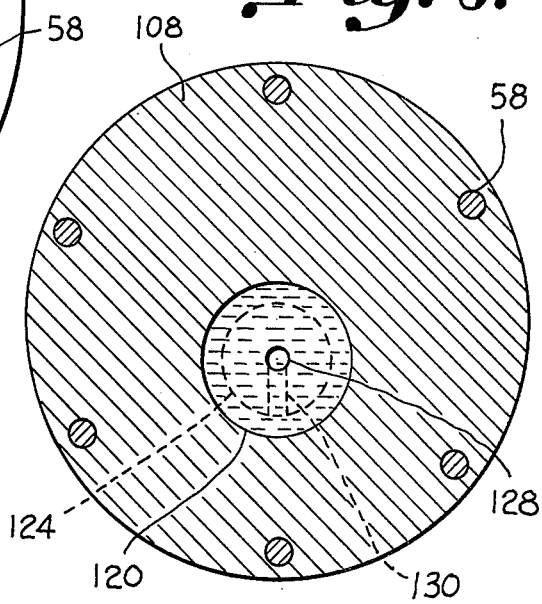
FIG. 8 is a sectional view taken along line 8—8 of FIG. 6.

A channel means is provided for transferring the fluid from one side of the rotating vane 110 to the other side by a pair of cutout portions 136 formed in the end surface face 116 of the rotor 106 and extending a short distance axially along the vane member 106 as best shown in FIGS. 6 and 7. In operation, the fluid moves from one side of the vane member 110 as it rotates through the channel means 136 through the clearance space 112 to the other side of the vane member 110. By increasing the clearance space 112 more fluid can be transferred from one side of the vane member 110 to the other reducing retardation of the rotation of the vane member 110 thus producing a faster descent rate. As the piston 120 moves away from the rotor surface 116, fluid is displaced from the spaces 132 and 134 into the clearance space 112 by way of radial bores 130 and axial bore 128. As the clearance space 112 is decreased, the speed of descent of the cable member 12 would also decrease as it is unwound from the rotating spool 10.

Thus, it can be seen that a highly effective descent device can be provided for emergency descents and for lowering equipment and objects from elevated places wherein a controlled speed of descent can be provided and in which the speed of descent can be easily varied. The device can be controlled to provide a slow rate of descent of a person descending from an elevated place during an emergency situation in a safe manner.

While a preferred embodiment of the invention has been described using specific terms, such description is for illustrative purposes only, and it is to be understood that changes and variations may be made without departing from the spirit or scope of the following claims.

What is claimed is:

1. A descent device for emergency descents and for lowering equipment from tall structures and the like comprising;

a cylindrical housing having an interior space containing a fluid;

a rotor shaft carried for rotation in said interior space having an end portion of reduced diameter extending through an opening in one end of said housing;

a spool member carried by said reduced end portion of said rotor shaft so as to rotate said rotor shaft when rotated in a first direction while being rotatable relative to said rotor shaft when rotated in a second, opposite direction;

a cable member wound about said spool member having one end connected thereto;

a diametrical slot formed in said rotor shaft carried for rotation in said interior space of said cylindrical housing;

a vane member slideably carried in said diametrical slot extending across said interior space of said housing;

channel means for transferring said fluid from one side of said vane member to the other as said vane member is rotated in said interior space by said rotor shaft to retard the rotation thereof; and an end cap member enclosing said cylindrical housing on an end opposite said end through which said reduced portion of said rotor shaft extends, means carried by said end cap providing an adjustable bypass channel around said vane member for said fluid contained in said interior of said housing so as to adjust said retarding force thereagainst;

whereby said fluid and said rotating vane member produce a retarding force on the rotation of said spool member in said first direction due to the unwinding of said cable member from said spool member and said adjustable bypass means may be adjusted so as to control the speed of descent of said cable.

2. The device as set forth in claim 1 further comprising a latch ring member carried by said reduced end portion of said rotor shaft for rotation therewith; and means connecting said latch ring member to said spool member as said cable member is unwound therefrom to rotate said rotor shaft in said first direction while permitting said spool member to be rotated relative to said rotor shaft when said spool member is rotated in said second direction to rewind said cable member thereon.

3. The device as set forth in claim 1 wherein said end cap member carries a cylinder head having a cylindrical bore formed therein opposing the end surface of said rotor shaft carried within said cylindrical housing interior; and a movable piston carried within said cylindrical bore being movable away from and toward said rotor shaft end surface to vary the clearance therebetween providing an adjustable bypass for fluid around said vane member.

4. The device as set forth in claim 3 wherein said piston includes a threaded piston stem received through a threaded opening in said cylinder head in one end opposite said cylindrical bore;

said piston stem further extending through an aligned opening in said end cap member; and a lever member connected to said piston stem extending on the exterior of said end cap whereby rotation of said lever varies the clearance between said piston and the end of said rotor shaft.

5. The device as set forth in claim 3 wherein said piston includes an axial internal bore having a plurality of radial bores extending outwardly therefrom providing channels for the displacement of said fluid as said piston moves in said cylindrical bore.

6. The device as set forth in claim 1 wherein said channel means includes a plurality of perforations formed in said vane member adjacent the ends thereof permitting said fluid to flow therethrough to retard the rotation of said rotor shaft and said spool member connected thereto during unwinding of said cable member.

7. The device as set forth in claim 1 wherein said channel means includes a cut-out portion in an end surface of said rotor shaft opposing said piston member so as to permit said fluid to move from one side of said vane member to the opposite side of said vane member by way of said channel means and said channel bypass.

* * * * *